US008528646B2

(12) United States Patent
Stezycki

(10) Patent No.: US 8,528,646 B2
(45) Date of Patent: Sep. 10, 2013

(54) BROKEN PIPE BLOCKER

(75) Inventor: Pawel Karol Stezycki, Warsaw (PL)

(73) Assignee: Vetco Gray Inc., Houston, TX (US)

( * ) Notice: Subject to any disclaimer, the term of this patent is extended or adjusted under 35 U.S.C. 154(b) by 277 days.

(21) Appl. No.: 13/086,839

(22) Filed: Apr. 14, 2011

(65) Prior Publication Data

US 2012/0261133 A1 Oct. 18, 2012

(51) Int. Cl.
*E21B 7/12* (2006.01)

(52) U.S. Cl.
USPC ..... 166/338; 166/341; 166/345; 166/351

(58) Field of Classification Search
USPC ..... 166/338, 341, 345, 351, 352, 363, 166/364, 367, 378–380, 85.1, 75.13
See application file for complete search history.

(56) References Cited

U.S. PATENT DOCUMENTS

| | | | | | |
|---|---|---|---|---|---|
| 2,553,981 | A | * | 5/1951 | Richardson | 285/3 |
| 2,787,051 | A | * | 4/1957 | Risley | 138/97 |
| 3,325,190 | A | * | 6/1967 | Eckert et al. | 285/18 |
| 3,338,596 | A | * | 8/1967 | Knox | 285/18 |
| 4,103,943 | A | * | 8/1978 | Curtin | 285/419 |
| 4,109,476 | A | * | 8/1978 | Gracia | 405/169 |
| 4,433,859 | A | | 2/1984 | Driver et al. | |
| 4,652,023 | A | * | 3/1987 | Timmons | 285/93 |
| 4,844,510 | A | * | 7/1989 | Theiss et al. | 285/18 |
| 4,892,149 | A | * | 1/1990 | Hoes et al. | 166/379 |
| 4,902,044 | A | | 2/1990 | Williams et al. | |
| 5,005,650 | A | * | 4/1991 | Hopper | 166/339 |
| 5,050,680 | A | * | 9/1991 | Diehl et al. | 166/356 |
| 5,205,358 | A | * | 4/1993 | Mitzlaff | 166/187 |
| 5,433,274 | A | | 7/1995 | Graff et al. | |
| 5,527,130 | A | * | 6/1996 | Webb | 405/52 |
| 5,983,934 | A | * | 11/1999 | Smith, III | 137/614.04 |
| 6,035,938 | A | | 3/2000 | Watkins | |
| 6,129,149 | A | | 10/2000 | Beall | |
| 6,171,029 | B1 | * | 1/2001 | McGill et al. | 405/249 |

(Continued)

FOREIGN PATENT DOCUMENTS

| | | | |
|---|---|---|---|
| DE | 202010009170 | U1 | 12/2010 |
| GB | 2443776 | | 5/2008 |
| GB | 2481220 | A | 12/2011 |
| NL | 2005082 | C | 12/2011 |

OTHER PUBLICATIONS

GB Search Report from corresponding Application No. GB1206097.6 dated Jul. 26, 2012.
U.S. Appl. No. 13/038,044, filed Mar. 1, 2011.

(Continued)

*Primary Examiner* — Matthew Buck
*Assistant Examiner* — Aaron Lembo
(74) *Attorney, Agent, or Firm* — Bracewell & Giuliani LLP

(57) ABSTRACT

An apparatus for blocking or capping a pipe end is disclosed. The apparatus includes a tubular body defining a central cavity having an inlet, an outlet, and an axis. The apparatus also includes a plurality of conical blocker rings mounted to an inner diameter surface of the tubular body within the cavity, at least some of the blocker rings being rigid and some of the blocker rings being compliant. The blocker rings are adapted to seal to a pipe end inserted into the central cavity. The rigid blocker rings have an outer diameter joined to an inner diameter of the central cavity, and the compliant blocking rings have an inner diameter smaller than an inner diameter of the rigid blocker rings and are adapted to seal around an exterior of the pipe when inserted from the inlet.

18 Claims, 5 Drawing Sheets

(56) References Cited

U.S. PATENT DOCUMENTS

| | | | | |
|---|---|---|---|---|
| 6,228,208 | B1 * | 5/2001 | Lill et al. | 156/345.1 |
| 6,311,775 | B1 * | 11/2001 | Allamon et al. | 166/285 |
| 6,328,343 | B1 | 12/2001 | Hosie et al. | |
| 6,330,918 | B1 | 12/2001 | Hosie et al. | |
| 6,405,762 | B1 * | 6/2002 | Bunch | 138/109 |
| 6,613,228 | B2 * | 9/2003 | Petersen et al. | 210/541 |
| 6,675,900 | B2 * | 1/2004 | Baskett et al. | 166/379 |
| 6,694,684 | B2 * | 2/2004 | Radke et al. | 52/232 |
| 6,732,762 | B2 * | 5/2004 | Russell | 138/89 |
| 6,743,360 | B2 * | 6/2004 | Petersen et al. | 210/541 |
| 6,817,417 | B2 * | 11/2004 | Blair et al. | 166/335 |
| 6,830,268 | B2 * | 12/2004 | Krausz et al. | 285/15 |
| 7,013,927 | B2 * | 3/2006 | Beaumont | 138/113 |
| 7,337,848 | B2 | 3/2008 | Fraser et al. | |
| 8,047,278 | B2 * | 11/2011 | Swietlik et al. | 166/90.1 |
| 2009/0308658 | A1 | 12/2009 | Larson et al. | |
| 2010/0143042 | A1 * | 6/2010 | Truong Dinh et al. | 405/184.1 |
| 2011/0089679 | A1 * | 4/2011 | Meredith et al. | 285/15 |
| 2012/0118580 | A1 * | 5/2012 | Swanson et al. | 166/344 |
| 2012/0261133 | A1 * | 10/2012 | Stezycki | 166/363 |

OTHER PUBLICATIONS

U.S. Appl. No. 12/975,100, filed Dec. 21, 2010.

U.S. Appl. No. 12/975,080, filed Dec. 21, 2010.

* cited by examiner

BROKEN PIPE BLOCKER

BACKGROUND OF THE INVENTION

1. Field of the Invention

This invention relates in general to capping or blocking a pipe end and, in particular, to capping of a broken subsea riser.

2. Brief Description of Related Art

In subsea drilling operations, drilling operators generally deploy remotely operated vehicles (ROVs) to the wellhead in emergency situations to enable devices designed to cap, cut off, or contain the flow of hydrocarbons from a well. In some instances, a remotely operated vehicle will activate a blowout preventer (BOP) designed to shut off the flow of hydrocarbons from the wellhead. Activating a BOP will engage rams within the BOP that pinch shut or otherwise disable the wellhead in a manner that significantly limits the ability of the operators to continue use of the wellhead. Therefore, there is a need for an apparatus to cap, cut off, or contain the flow of hydrocarbons from a wellhead without limiting the ability of the operators to continue to use the wellhead.

A second way drilling operators attempt to contain flow of hydrocarbons from a wellhead in emergency situations involves a containment dome or "Top Hat". Use of a containment dome involves lowering a large device over the wellhead to contain flowing hydrocarbons. Oil workers attach riser pipes to the containment dome to remove the hydrocarbons collected within the containment dome. In this manner, the containment dome captures hydrocarbons from a wellhead for transportation to surface vessels. However, use at the depths of some deepwater drilling sites causes methane hydrate crystals to form within the containment dome. These methane hydrate crystals block the openings that oil workers use to remove hydrocarbons from the containment dome preventing capture of the hydrocarbons.

Operators may simply attempt to place a cap having a sufficient weight to overcome the pressure of the wellbore fluids on top of the wellhead. However, in many situations the wellbore riser does not have a suitable surface for the cap, and the wellbore fluids may flow at too great of a pressure to be overcome by the weight of the cap. In some instances, operators may attempt to weld a flange over the pipe end to block the pipe passageway. However, due to the operating conditions at many subsea wellheads, and the pressures of the wellbore fluids, welding a flange to the pipe end is often not possible. Therefore, there is a need for an apparatus to aid in the blockage or capture of hydrocarbons from a wellhead located at great depth without relying on weight or an operators ability to weld subsea.

Oil operators sometimes engage a method called "top kill" to cap or cut off the flow of hydrocarbons from a wellhead in emergency situations. In this procedure, oil workers connect drilling pipe to the BOP through a manifold. Oil workers then pump drilling mud into the well in sufficient quantities to slow and then stop the passage of hydrocarbons from the wellhead. Once the drilling mud reaches sufficient quantities to overcome the reservoir pressure at the wellhead, hydrocarbon flow stops, and oil workers use cement to seal the well. In instances where drilling mud alone is insufficient to stop hydrocarbon flow, oil workers will utilize a "junk shot". A junk shot involves pumping materials of a more solid nature along with more drilling mud into the wellhead in an effort to block or plug the flow of hydrocarbons. Much like use of a BOP, top kill and junk shots effectively stop any further use of the wellhead for the production of hydrocarbons. In addition, many times junk shots are ineffective, failing to stop flow of fluids from the wellhead. Therefore, there is a need for an apparatus that can stop hydrocarbon flow from a wellhead without limiting further use of the well or relying on ineffective junk shots.

Another method operators use to contain the flow of hydrocarbons from a wellhead in emergency situations involves cutting off the end of a lower riser and capping the wellhead with a modified Lower Marine Riser Package (LMRP). This method, similar to the containment dome, attempts to direct the flow of hydrocarbons into a subsea containment vessel from which oil workers pump the hydrocarbons for further action. Unlike the containment dome, LMRP does not attempt to collect and contain all the hydrocarbons from the wellhead. Thus, even where used, all hydrocarbon flow is not stopped or contained. LMRP also makes complete capping of the well more difficult by shearing off the riser line. Shearing off the riser line removes any blockages from the hydrocarbon path that slowed the rate of hydrocarbon flow, thus making it more difficult to eventually cap or contain the well completely. At times, shearing off the end of a lower riser is necessary to perform other operations at the wellhead. Thus, there is a need for an apparatus that can cap, cut off, or contain the flow of hydrocarbons where a riser has been sheared off for other purposes.

SUMMARY OF THE INVENTION

These and other problems are generally solved or circumvented, and technical advantages are generally achieved, by preferred embodiments of the present invention that provide a broken pipe blocker, and a method for using the same.

In accordance with an embodiment of the present invention, a pipe blocker for blocking a pipe is disclosed. The pipe blocker includes a tubular body defining a central cavity having an inlet, an outlet, and an axis. The pipe blocker also includes a plurality of conical blocker rings mounted to an inner diameter surface of the tubular body within the cavity, at least some of the blocker rings being rigid and some of the blocker rings being compliant. The blocker rings are adapted to seal to a pipe end inserted into the central cavity. The rigid blocker rings have an outer diameter joined to an inner diameter of the central cavity, and the compliant blocking rings have an inner diameter smaller than an inner diameter of the rigid blocker rings and are adapted to seal around an exterior of the pipe when inserted from the inlet.

In accordance with another embodiment of the present invention, a system for blocking fluid flow from a damaged pipe is disclosed. The system includes a tubular body defining a central cavity having an inlet, an outlet, and an axis. The system also includes a plurality of conical blocker rings mounted to an inner diameter surface of the tubular body within the cavity, at least some of the blocker rings being rigid and some of the blocker rings being compliant. The blocker rings are adapted to seal to a pipe end inserted into the central cavity. The rigid blocker rings have an outer diameter joined to an inner diameter of the central cavity. The compliant blocker rings have an inner diameter smaller than an inner diameter of the rigid blocker rings and are adapted to seal around an exterior of the pipe when inserted from the inlet. The blocker rings are secured to the tubular body so that an outer diameter of each blocker ring, where the blocker ring secures to the tubular body, is axially lower than the inner diameter of the blocker ring. The outer diameter of each rigid blocker ring is secured to the inner diameter of the cavity, and the rigid blocker rings alternate with the compliant blocker rings.

In accordance with yet another embodiment of the present invention, a method for blocking an end of a subsea pipe is disclosed. The method comprises providing a pipe blocker. The pipe blocker includes a tubular body defining a central cavity having an inlet, an outlet, and an axis. The pipe blocker also includes a plurality of conical blocker rings mounted to an inner diameter surface of the tubular body within the cavity, at least some of the blocker rings being rigid and some of the blocker rings being compliant. The blocker rings are adapted to seal to a pipe end inserted into the central cavity. The rigid blocker rings have an outer diameter joined to an inner diameter of the central cavity, and the compliant blocker rings have an inner diameter smaller than an inner diameter of the rigid blocker rings and are adapted to seal around an exterior of the pipe when inserted from the inlet. The method continues by inserting the pipe blocker over the pipe end, causing the complaint blocker rings to seal against an outer diameter of the pipe. Next, the method allows fluid from the pipe to enter an annular space between the pipe and an inner diameter of the cavity to act against an upper surface of the uppermost compliant blocker ring.

An advantage of a preferred embodiment is that the disclosed embodiments provide an apparatus to cap, block, or contain wellbore fluid flow from a subsea wellhead. The apparatus may completely close off the flow of wellbore fluids from the wellhead. The apparatus may also allow a subsequent device to connect to the wellhead to direct the flow of wellbore fluids to a containment or entrapment device. The apparatus can achieve this with any size or length of wellhead pipe or riser, regardless of the landing surface of the riser and without significant redesign based on the ambient environment.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning subsea operations, drilling rig operation, running of equipment to subsea locations, and the like have been omitted inasmuch as such details are not considered necessary to obtain a complete understanding of the present invention, and are considered to be within the skills of persons skilled in the relevant art.

Figure 1:
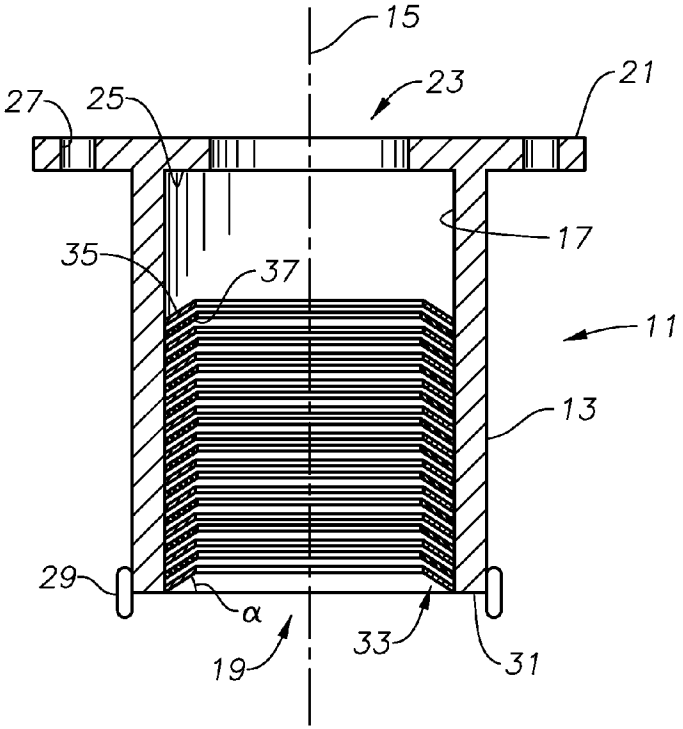
FIG. 1 is a sectional view of a pipe blocker in accordance with an embodiment of the present invention.

Referring to FIG. 1, a pipe blocker 11 includes a tubular member 13 having an axis 15. Tubular member 13 defines a central cavity 17. Central cavity 17 has a diameter of a size and shape to accommodate insertion of a riser end or other pipe end into cavity 17. Tubular member 13 has an inlet or opening 19 at a lower end of tubular member 13. In the illustrated embodiment, opening 19 has a diameter equivalent to the diameter of central cavity 17. This allows pipe blocker 11 to more readily adapt to insertion of a pipe end into cavity 17.

A flange 21 secures to tubular member 13 on an upper end of tubular member 13 opposite opening 19. Flange 21 may screw, bolt, or weld to tubular member 13. In addition, as shown herein, flange 21 may be formed as an integral part of tubular member 13. Flange 21 has an outer diameter larger than the outer diameter of tubular member 13 and in inner diameter smaller than the diameter of cavity 17. In this manner flange 21 defines an outlet or opening 23, and an annular downward facing shoulder 25. Downward facing shoulder 25 extends radially inward from an inner diameter surface of tubular member 13 defining cavity 17 to the diameter of opening 23. Flange 21 may include boreholes 27 formed proximate to an exterior diameter of flange 21. Boreholes 27 will accommodate couplers allowing other subsea devices, such as a subsea valve, to be coupled and secured to pipe blocker 11 at boreholes 27.

Tubular member 13 includes a manipulation member 29 secured to a lower end of tubular member 13. Manipulation member 29 may be a ring, wire, block, shoulder, or protrusion from tubular member 13. Manipulation member 29 extends below a rim 31 of tubular member 13. Manipulation member 29 may be gripped by an operator, a remotely operated vehicle (ROV), or the like to assist in the guidance of pipe blocker 11 during deployment at a wellhead. Manipulation member 29 may also be used to secure weight to pipe blocker 11 to assist in the deployment and sealing of pipe blocker 11 to a pipe (not shown) as described below. Tubular member 13 may include a plurality of manipulation members 29. For example, a manipulation member 29 may be placed every 30, 45, or 60 degrees around the exterior of tubular member 13. A person skilled in the art will understand any number of manipulation members 29 may be used as needed for the particular application of pipe blocker 11.

A plurality of blocker rings 33 are mounted within cavity 17 of tubular member 13. Blocker rings 33 are conical such that they are positioned at an angle $\alpha$ from the horizontal plane perpendicular to the inner diameter surface defining cavity 17 of tubular member 13. Blocker rings 33 face downward, each blocker ring 33 having its inner diameter above its outer diameter. In the illustrated embodiment, blocker rings 33 include two types of rings, rigid blocker rings 35 and compliant blocker rings 37. Rigid blocker rings 35 may be formed of metal and welded to the inner diameter surface defining cavity 17. The weld should extend completely around the outer diameter of rigid blocker ring 35, blocking any fluid flow between the outer diameter of rigid blocker ring 35 and the inner diameter of cavity 17. Rigid blocker rings 35 have an inner diameter equivalent to or slightly smaller than the diameter of opening 23 so that a radial width, measured along a radial line from axis 15, of each rigid blocker ring 35 is larger than the radial width of downward facing shoulder 25. Preferably, the inner diameter of each compliant blocker ring 37 is smaller than the outer diameter of a pipe inserted into cavity 17 as described in more detail below.

Compliant blocker rings 37 may be formed of an elastomeric material and have outer diameters closely spaced or touching the inner diameter surface defining cavity 17. In alternative embodiments, compliant blocker rings 37 may be secured to the inner diameter surface of cavity 17 with an adhesive or other suitable means so as to create a seal between the inner diameter surface of cavity 17 and compliant blocker rings 37. Compliant blocker rings 37 have an inner diameter smaller than the inner diameter of rigid blocker rings 35 such that compliant blocker rings 37 have a radial width greater than the radial width of rigid blocker rings 35. As shown, a rigid blocker ring 35 is the upper most ring of the plurality of blocker rings 33. The upper most ring is axially below downward facing shoulder 25 but spaced axially a sufficient distance to allow fluid to flow around and out of the upper end of a pipe 39, as described below with respect to FIG. 2. Referring to FIG. 1, a compliant blocker ring 37 is then axially adjacent to the upper most rigid blocker ring 35. A rigid blocker ring 35 then follows the compliant blocker ring 37. Rigid blocker rings 35 and compliant blocker rings 37 are alternated as they are positioned axially beneath one another within cavity 17.

Generally, rigid blocker rings 35 will resist deformation when pipe 39 inserts into cavity 17, and will prevent total deformation of the adjacent compliant blocker rings 37, allowing compliant blocker rings 37 to deform while maintaining sealing contact with pipe 39. Complaint blocker rings 37 may be bonded or secured to an adjacent rigid blocker ring 35 axially below the individual compliant blocker ring 37. In this manner additional sealing is achieved to prevent passage of a fluid between compliant blocker rings 37 and rigid blocker rings 35. In still other embodiments, a small metal assembly ring may be used to secure compliant blocker rings 37 to cavity 17. A person skilled in the art will understand that the order of the rigid blocker rings 35 and the complaint blocker rings 37 may be reversed provided rigid blocker rings 35 still perform a supportive function for complaint blocker rings 37.

Pipe blocker 11 will have a sufficient axial length to accommodate pipe ends with varying upper profiles. A sufficient number of blocker rings 33 will be placed axially down the inner diameter surface of tubular member 13 defining cavity 17 so that pipe blocker 11 may secure to a pipe end having a varying profile, such as when the pipe end has been severed or includes an opening partially along the side of the pipe end. The number of rings used may depend in part on the shape of the shape of the end of pipe 39, and the force of the fluid flowing from pipe 39. A person skilled in the art will understand that angle $\alpha$, the material used to form rigid metal rings 35 and compliant metal rings 37, the number of rigid metal rings 35 and compliant metal rings 37, and the thickness of each ring from a downhole surface of each ring to the uphole surface of each ring may be varied and selected based on the particular application of pipe blocker 11. For example, material selection of both rigid blocker rings 35 and metal blocker rings 37 are dependent upon the substance flowing through pipe 39, the ambient environment, and the relative stiffness needed in each type of blocker ring 33. Generally, rigid blocker rings 35 will have a greater stiffness than compliant blocker rings 37.

Figure 2:
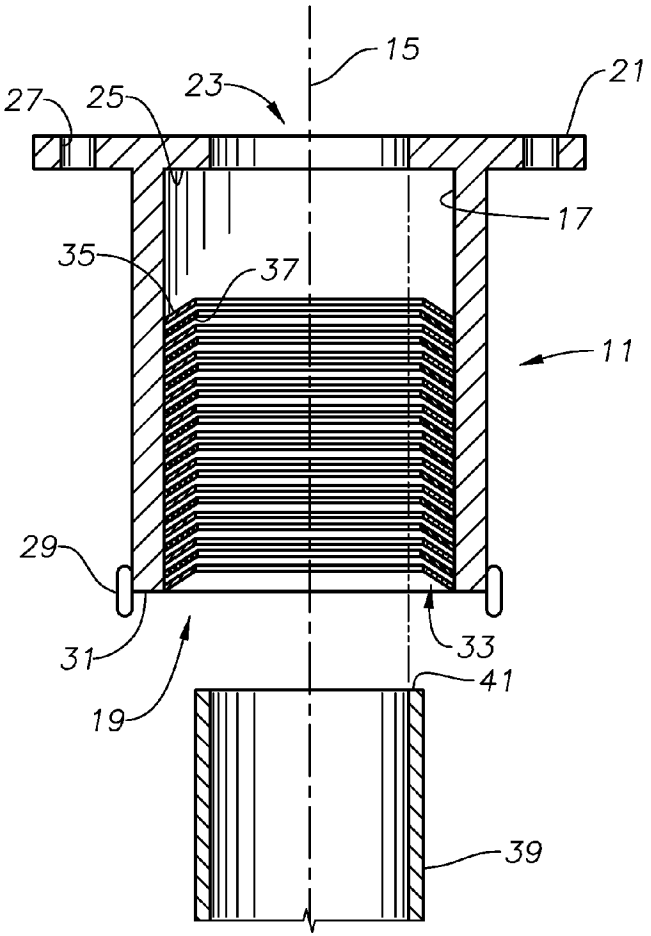
FIG. 2 is a sectional view of the pipe blocker of FIG. 1 in position proximate to a pipe end.
Figure 6:
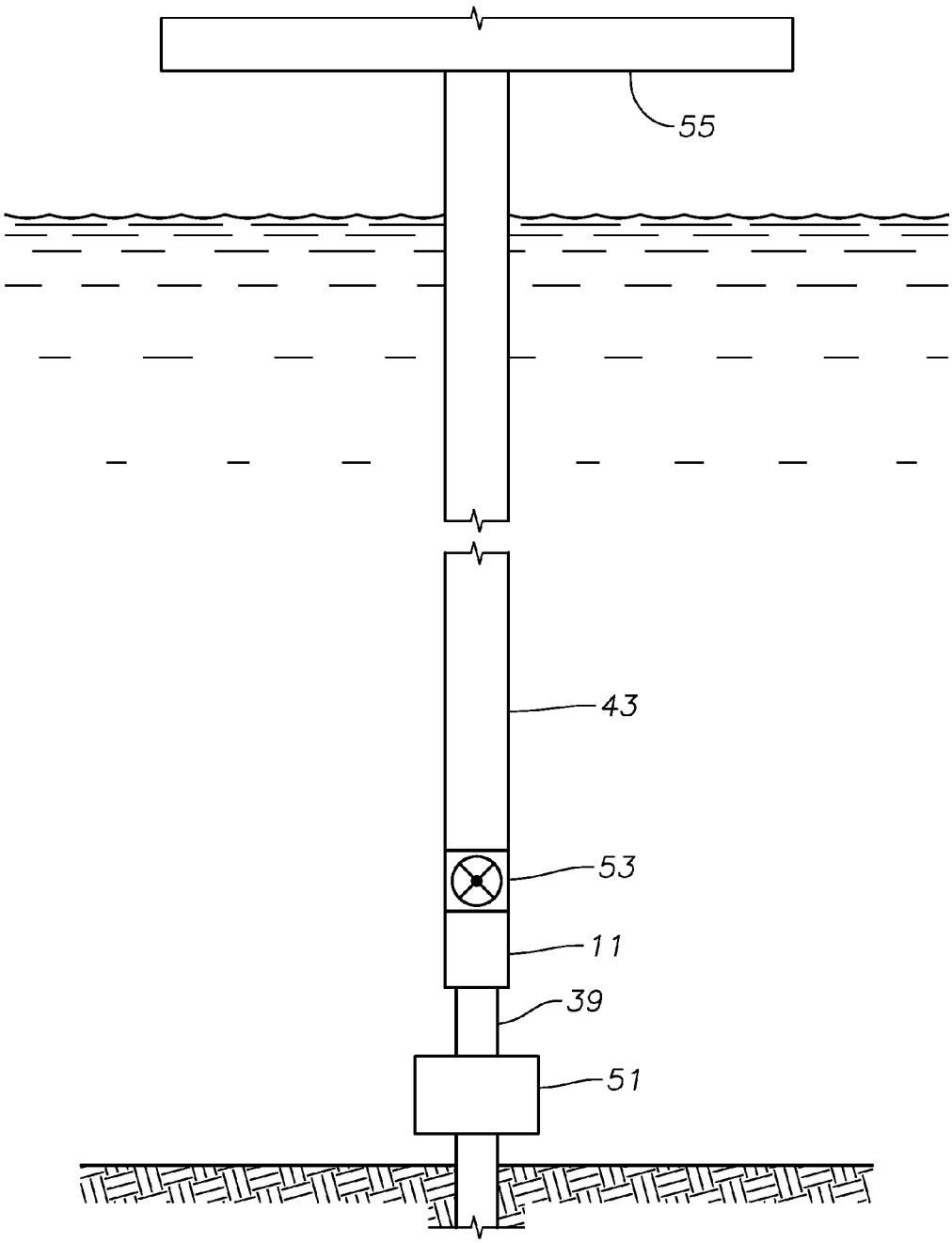
FIG. 6 is a schematic view of the pipe blocker of FIG. 1 as part of a subsea riser system.

Referring to FIG. 2, pipe blocker 11 is shown in position above a pipe 39. Pipe blocker 11 may be brought proximate to pipe 39 by any suitable means, such as running pipe blocker 11 to the location on a riser or with ropes when in a subsea environment, lifted into place by a crane or rig when in a surface environment, or the like. Opening 23 is approximately equal to the inner diameter of pipe 39 such that an upper rim 41 of pipe 39 may land on and abut downward facing shoulder 25. Pipe 39 will have an outer diameter less than the diameter of cavity 17 such that pipe 39 may insert into cavity 17. Preferably, pipe blocker 11 will be positioned coaxial with pipe 39. However, if pipe blocker 11 is not coaxial with pipe 39, an operator or an ROV may grip manipulation member 29 and adjust the physical position of pipe blocker 11 relative to pipe 39, which may be secured to a wellhead or lower marine riser package (FIG. 6).

Figure 3:
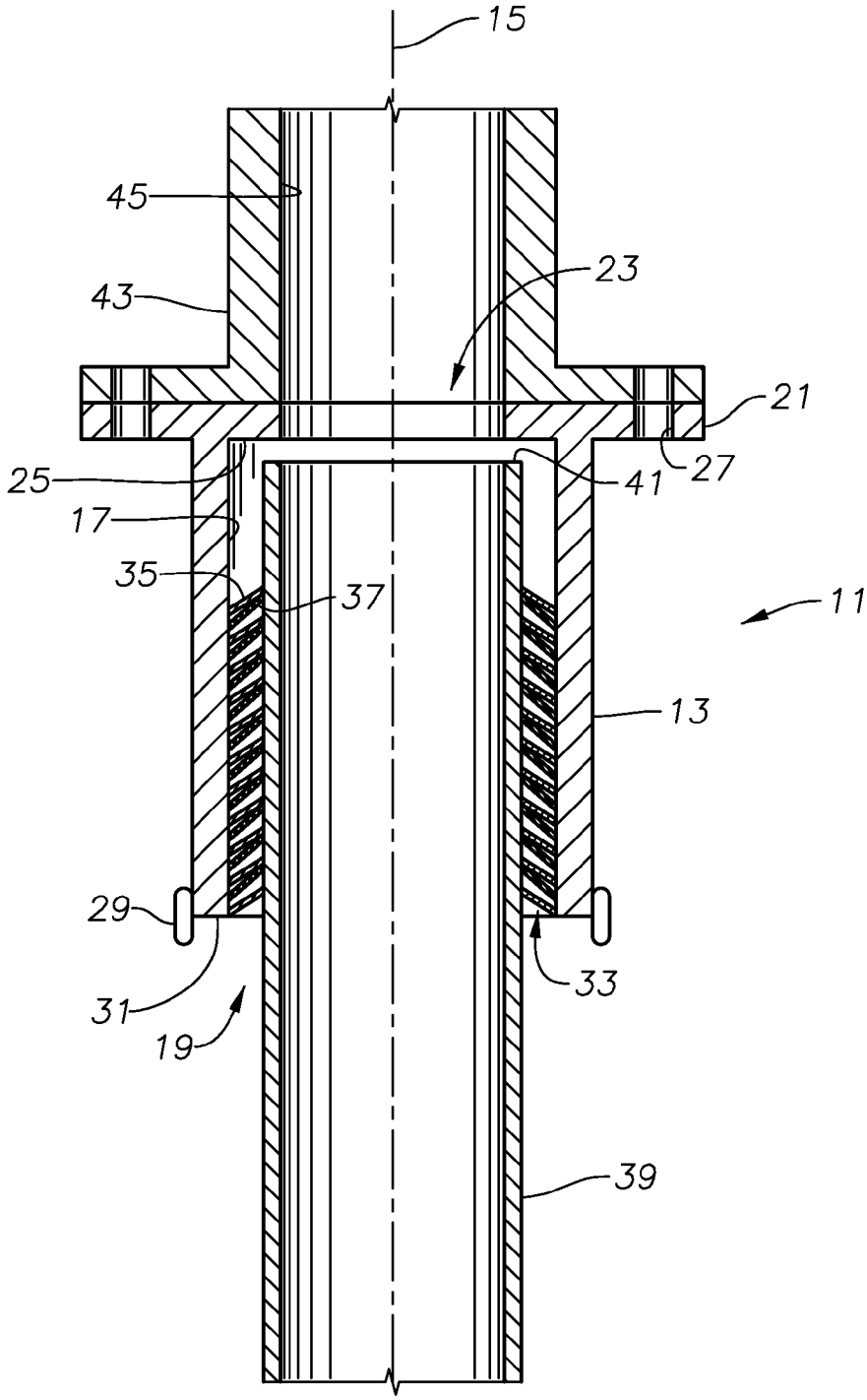
FIG. 3 is a sectional view of the pipe blocker of FIG. 1 in place on a pipe end.

Referring to FIG. 3, pipe 39 will be inserted into cavity 17 of pipe blocker 11. A riser 43 is coupled to the pipe blocker 11 and may extend to the surface, a containment dome, or the like. As described herein, riser 43 will include a valve (not shown) allowing for passage 45 of riser 43 to be variably blocked. The inner diameter of compliant blocker rings 37 will contact and deform against an exterior diameter surface of pipe 39. The inner diameter of rigid blocker rings 35 are closely spaced to the outer diameter of pipe 39. Compliant blocker rings 37 will experience a slight upward displacement as pipe 39 is inserted into cavity 17 and may extrude into tighter sealing contact with pipe 39. The material properties of compliant blocker rings 37 will cause blocker rings 33 to react against this displacement to set an initial seal along the outer diameter surface of pipe 39. Rigid blocker rings 35 maintain complaint blocker rings 37 in a conical configuration. The upward force causes each compliant blocker ring 37 to seal against one of the rigid blocker rings 35. During landing of pipe blocker 11 on pipe 39, the valve within riser 43 will be open allowing for passage of wellbore fluids through passage 45.

Once pipe blocker 11 is landed in the position shown in FIG. 3, the valve within riser 43 will be closed, blocking passage 45. A person skilled in the art will understand that any suitable means to block passage 45 are contemplated and included in the disclosed embodiments. Wellbore fluid pressure will then build within cavity 17 and passage 45 above blocker rings 33. Pipe 39 does not seal to downward facing shoulder 25. The fluid thus flows down around the exterior of pipe 39 until reaching blocker rings 33. Continued build up of fluid pressure within cavity 17 axially above blocker rings 33 will cause a downward axial force to be exerted on blocker rings 33. This will press compliant blocker rings 37 into tighter contact with pipe 39, thereby increasing the seal between blocker rings 33, the inner diameter surface of cavity 17, and pipe 39. Further increases in fluid pressure within cavity 17 may cause fluid to leak past the upper blocker rings 33 proximate to riser 43. However, the plurality of blocker rings 33 extending down the inner diameter surface of cavity 17 will form a labyrinth seal decreasing the likelihood of any leakage around blocker rings 33 in the surrounding environment.

In some instances the upward force of the wellbore fluids in pipe 39 may be so great that the weight of pipe blocker 11 and pressure seals at blocker rings 33 will not be sufficient to hold pipe blocker 11 in place over pipe 39. In these instances, weights may be landed on and suspended from manipulation member 29. The additional weight suspended from manipulation member 29 will overcome the upward force of the wellbore fluids leaving pipe 39.

Figure 4:
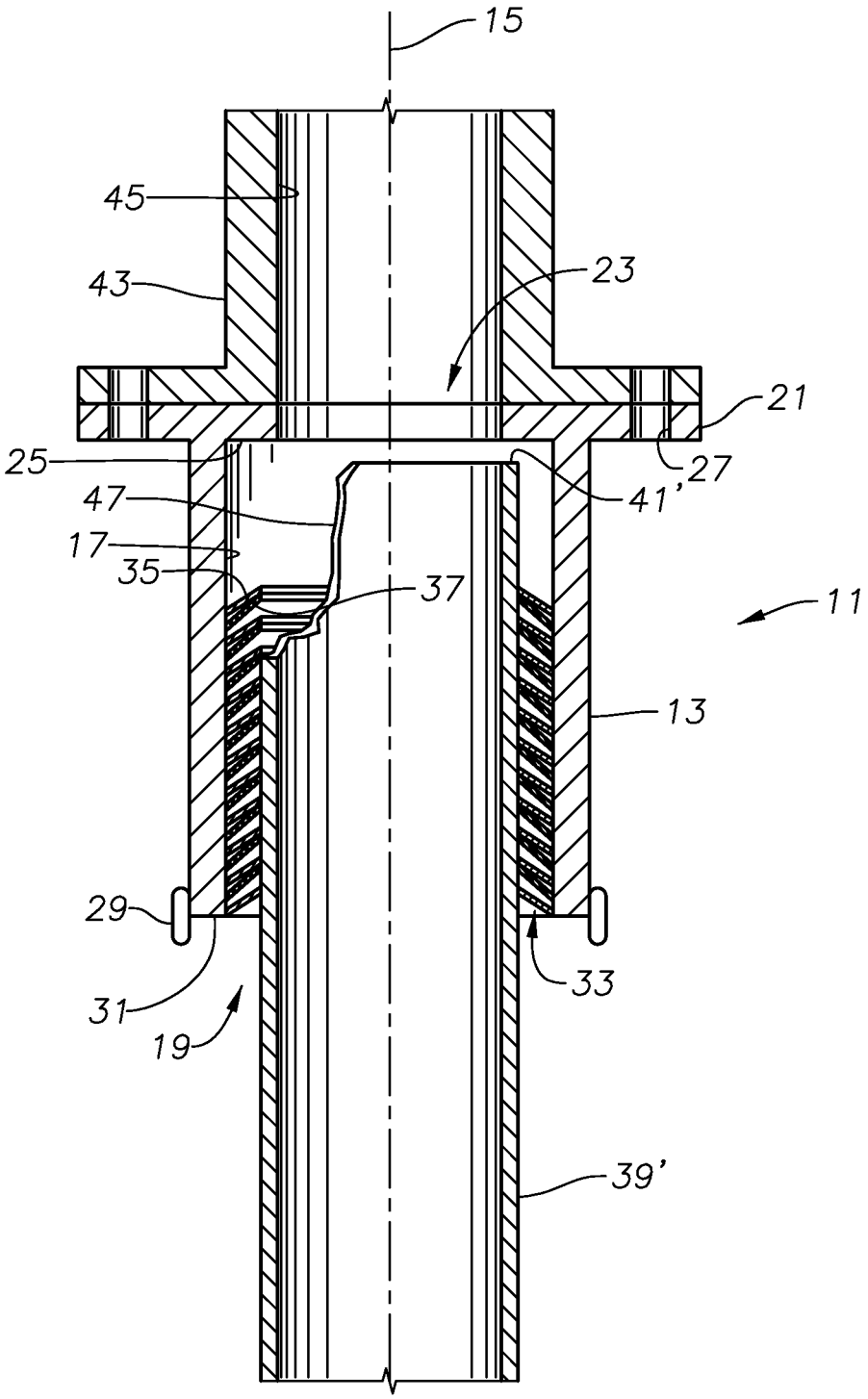
FIG. 4 is a sectional view of the pipe blocker of FIG. 1 in place on an alternate pipe end.

Referring to FIG. 4, a pipe 39' may include a portion 47 that has been damaged or removed from pipe 39' prior to placement of pipe blocker 11. As described above with respect to FIG. 3, pipe 39' of FIG. 4 will be inserted into cavity 17 of pipe blocker 11. Riser 43 is coupled to pipe blocker 11 and may extend to the surface, a containment dome, or the like. As described herein, riser 43 will include a valve (not shown) allowing for passage 45 of riser 43 to be blocked. Compliant blocker rings 37 will contact and seal against an exterior diameter surface of pipe 39'. In so doing, compliant blocker rings 37 will experience a slight upward displacement as pipe 39' is inserted into cavity 17. As shown herein, while pipe blockers 33 will not contact pipe 39' at portion 47, the plurality of pipe blockers 33 extending down the length of cavity 17 will contact pipe 39' below portion 47, providing a sealing area as described in more detail below. The material properties of blocker rings 33 will cause blocker rings 33 to react against this displacement to set an initial seal along the outer diameter surface of pipe 39'. During landing of pipe blocker 11 on pipe 39', the valve within riser 43 will be open allowing for passage of wellbore fluids through passage 45.

Once pipe blocker 11 is landed within the position shown in FIG. 4, the valve within riser 43 will be closed, blocking passage 45. Wellbore fluid pressure will then build within cavity 17 and passage 45 above blocker rings 33. Continued build up of fluid pressure within cavity 17 axially above blocker rings 33 will cause a downward axial force to be exerted on blocker rings 33. This will press compliant blocker rings 37 into tighter contact with pipe 39' thereby increasing the seal between blocker rings 33, the inner diameter surface of cavity 17, and pipe 39'. Further increases in fluid pressure within cavity 17 may cause fluid to leak past the upper blocker rings 33 proximate to riser 43. However, the plurality of blocker rings 33 extending down the inner diameter surface of cavity 17 will form a labyrinth seal decreasing the likelihood of any leakage around blocker rings 33.

Figure 5:
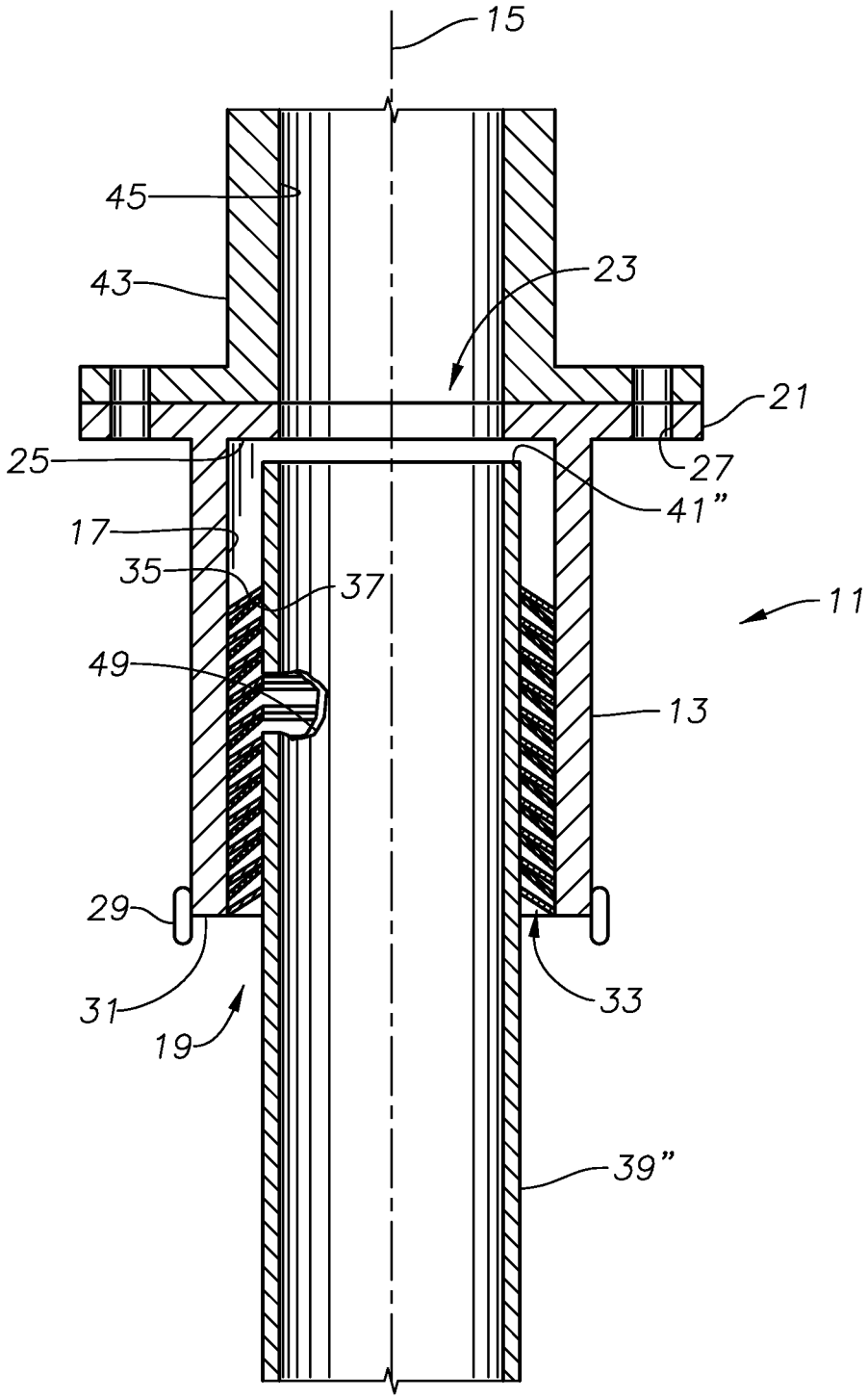
FIG. 5 is a sectional view of the pipe blocker of FIG. 1 in place on an alternate pipe end.

Referring to FIG. 5, a pipe 39" may include a side opening 49 that has been damaged or removed from pipe 39" prior to placement of pipe blocker 11. As described above with respect to FIG. 3, pipe 39" of FIG. 5 will be inserted into cavity 17 of pipe blocker 11. Riser 43 is coupled to the pipe blocker 11 and may extend to the surface, a containment dome, or the like. As described herein, riser 43 will include a valve (not shown) allowing for passage 45 of riser 43 to be blocked. Complaint blocker rings 37 will contact and seal against an exterior diameter surface of pipe 39". In so doing, complaint blocker rings 37 will experience a slight upward displacement as pipe 39" is inserted into cavity 17. As shown herein, while pipe blockers 33 will not contact pipe 39" at opening 49, the plurality of pipe blockers 33 extending down the length of cavity 17 will contact pipe 39" below opening 49, providing a sealing area as described in more detail below. Similarly, the plurality of pipe blockers 33 extending the length of cavity 17 above opening 49 of pipe 39" will contact pipe 39" above opening 49, providing a sealing area as described in more detail below. The material properties of blocker rings 33 will cause blocker rings 33 to react against this displacement to set an initial seal along the outer diameter surface of pipe 39. During landing of pipe blocker 11 on pipe 39", the valve within riser 43 will be open allowing for passage of wellbore fluids through passage 45.

Once pipe blocker 11 is landed within the position shown in FIG. 5, the valve within riser 43 will be closed, blocking passage 45. Wellbore fluid pressure will then build within cavity 17 and passage 45 above blocker rings 33. Continued build up of fluid pressure within cavity 17 axially above blocker rings 33 will cause a downward axial force to be exerted on blocker rings 33. This will press complaint blocker rings 37 into tighter contact with pipe 39" thereby increasing the seal between blocker rings 33, the inner diameter surface of cavity 17, and pipe 39". Further increases in fluid pressure within cavity 17 may cause fluid to leak past the upper blocker rings 33 proximate to riser 43. However, the plurality of blocker rings 33 extending down the inner diameter surface of cavity 17 will form a labyrinth seal decreasing the likelihood of any leakage around blocker rings 33.

As shown in FIG. 5, passage of fluid from opening 49 may cause negative direction pressure on blocker rings 33 at or above opening 49 that may force pipe blocker 11 off of pipe 39". In this situation, additional ballast or weight may be hung from manipulation blocks 29 to counteract this upward force. Alternatively, pipe blocker 11 may be constructed such that blocker rings 33 will not extend the axial length of tubular member 13 above opening 49. In yet another alternative embodiment, blocker rings 33 that extend the axial length above opening 49 may be modified to increase the inner diameter of blocker rings 33 above opening 49 so that they will not contact pipe 39" above opening 40, thereby allowing fluid to pass from opening 49 to cavity 17 without the ability to exert a force on blocker rings 33 that may remove pipe blocker 11 from pipe 39".

Referring to FIG. 6, pipe blocker 11 may be coupled inline to riser 43, and a valve 53 may be coupled inline with pipe blocker 11 between pipe blocker 11 and riser 43. Pipe 39 will further couple to a lower marine riser package (LMRP) 51. LMRP 51 may include a blowout preventer (BOP) or other subsea wellhead device. Riser 43 may extend to a sea surface and be further supported on a platform 55 by a riser tensioner system or rig.

Accordingly, the disclosed embodiments provide numerous advantages. For example, the disclosed embodiments provide a pipe blocker that can be secured to a damaged subsea pipe. The pipe blocker can then block flow from the pipe or provide a means to direct flow from the pipe into an appropriate device. The pipe blocker accomplishes this by using the internal increase in pressure caused by the flow of wellbore fluids from the damaged pipe. In this manner, the seal or cap created by the pipe blocker increases as pressure from the pipe builds up. Still further, the disclosed embodiments provide a plurality of sealing surfaces, thereby increasing the redundancy of the pipe blocker seals and decreasing the likelihood that the pipe blocker will fail. The redundancy also allows the pipe blocker to be used in multiple environments on pipes that do not have a traditional landing surface, or that may have damaged portions below the traditional landing surface.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A pipe blocker for blocking a broken subsea pipe comprising:

a tubular body defining a central cavity having an inlet, an outlet, and an axis;

a plurality of conical blocker rings mounted to an inner diameter surface of the tubular body within the cavity, at least some of the blocker rings being rigid and some of the blocker rings being compliant;

the blocker rings adapted to seal to a pipe end inserted into the central cavity;

the rigid blocker rings having an outer diameter joined to an inner diameter of the central cavity;

the compliant blocker rings having an inner diameter smaller than an inner diameter of the rigid blocker rings and adapted to seal around an exterior of the pipe when inserted from the inlet; and wherein a conical surface of each compliant blocker ring seals against a conical surface of at least one rigid blocker ring.

2. The pipe blocker of claim 1, wherein the outer diameter of each rigid blocker ring is secured to the inner diameter of the central cavity.

3. The pipe blocker of claim 1, wherein the rigid blocker rings alternate with the compliant blocker rings.

4. The pipe blocker of claim 1, wherein the rigid blocker rings are formed of a metal and the outer diameters of the rigid blocker rings are welded to the inner diameter of the central cavity.

5. The pipe blocker of claim 1, wherein the compliant blocker rings are formed of an elastomer.

6. The pipe blocker of claim 1, further comprising a downward facing annular shoulder at the outlet within the central cavity, the downward facing shoulder adapted to be abutted by an end of the pipe when the pipe is inserted into the central cavity.

7. The pipe blocker of claim 6, wherein a closest one of the blocker rings is axially spaced from the shoulder to allow fluid in the pipe to act against at least some of the blocker rings in a direction toward the inlet.

8. The pipe blocker of claim 1, wherein a flange is formed on an exterior upper end of the tubular body, the flange adapted to secure the pipe blocker to subsequent subsea devices.

9. The pipe blocker of claim 1, further comprising a manipulation member secured to an end of the tubular body and adapted to be interacted with by at least one of an operator or a remotely operated vehicle.

10. A pipe blocker for blocking a pipe comprising:

a tubular body defining a central cavity having an inlet, an outlet, and an axis;

a plurality of conical blocker rings mounted to an inner diameter surface of the tubular body within the central cavity, at least some of the blocker rings being rigid and some of the blocker rings being compliant;

the blocker rings adapted to seal to a pipe end inserted into the central cavity;

the rigid blocker rings having an outer diameter joined to an inner diameter of the central cavity;

the compliant blocking rings having an inner diameter smaller than an inner diameter of the rigid blocker rings and adapted seal around an exterior of the pipe when inserted from the inlet;

the blocker rings secured to the tubular body so that an outer diameter each blocker ring, where the blocker ring secures to the tubular body, is axially lower than the inner diameter of the blocker ring;

the outer diameter of each rigid blocker ring is secured to the inner diameter of the central cavity; and the rigid blocker rings alternate with the compliant blocker rings.

11. The pipe locker of claim 10, when the rigid blocker rings are formed of a metal and the outer diameters of the rigid blocker rings are welded to the inner diameter of the central cavity; and the compliant blocker rings are formed of an elastomer.

12. The pipe blocker of claim 10, wherein:

a conical surface of each compliant blocker ring seals against a conical surface of at least one rigid blocker ring; and the conical surfaces of the complaint and rigid blocker rings are at the same angle.

13. The pipe blocker of claim 10, further comprising:

a downward hieing annular shoulder at the outlet within the central cavity, the downward facing shoulder adapted to be abutted by an end of the pipe when the pipe is inserted into the central cavity; and an upper blocker ring is axially spaced below the shoulder to allow fluid in the pipe to act against at least some of the blocker rings in a direction toward the inlet.

14. The pipe blocker of claim 10, wherein:

a flange is formed on an exterior upper end of the tubular body, the flange adapted to secure the pipe blocker to subsequent subsea devices; and a manipulation member is secured to an end of the tubular body and adapted to be interacted with by at least one of an operator or a remotely operated vehicle.

15. A method for blocking an end of a subsea pipe, comprising:

(a) providing a pipe blocker having:

a tubular body defining a central cavity having an inlet, an outlet, and an axis;

a plurality of conical blocker rings mounted to an inner diameter surface of the tubular body within the central cavity, at least some of the blocker rings being rigid and some of the blocker rings being compliant;

the blocker rings adapted to seal to a pipe end inserted into the central cavity;

the rigid blocker rings having an outer diameter joined to an inner diameter of the central cavity; and the compliant blocker rings having an inner diameter smaller than an inner diameter of the rigid blocker rings and adapted to seal around an exterior of the pipe when inserted from the inlet;

(b) inserting the pipe blocker over the pipe end, causing the complaint blocker rings to seal against an outer diameter of the pipe; then (c) allowing fluid from the pipe to enter an annular space between the pipe and an inner diameter of the central cavity to act against an upper surface of the uppermost compliant blocker ring.

16. The method claim 15, wherein step (b) comprises:

running the pipe blocker from a surface location to a subsea location axially above the pipe end; and physically moving the pipe blocker over the pipe end.

17. The method of claim 15, wherein step (c) comprises:

providing a downward facing annular shoulder at an upper end of the central cavity; and step (b) comprises abutting an end of the pipe against but not sealing to the downward facing shoulder.

18. The method of claim 15, wherein step (c) causes conical surfaces of each compliant blocker ring to seal against conical surfaces of adjacent rigid blocker rings.

* * * * *